United States Patent [19]

Stewart et al.

[11] 4,127,069

[45] Nov. 28, 1978

[54] RAILROAD TRACK SHIFTING MACHINE WITH SHIFT LIMITING DEVICE

[75] Inventors: John K. Stewart, Lexington; Helmuth von Beckmann, Columbia, both of S.C.

[73] Assignee: Canron Corp., West Columbia, S.C.

[21] Appl. No.: 855,341

[22] Filed: Nov. 28, 1977

Related U.S. Application Data

[63] Continuation-in-part of Ser. No. 694,040, Jun. 8, 1976, abandoned.

[51] Int. Cl.[2] ..... E01B 29/04

[52] U.S. Cl. ..... 104/7 R; 33/1 Q; 104/8

[58] Field of Search ..... 104/7 R, 7 A, 7 B, 2, 104/8; 33/1 Q, 338

[56] References Cited

U.S. PATENT DOCUMENTS

| | | | |
|---|---|---|---|
| 3,009,251 | 11/1961 | Plasser et al. | 104/7 R |
| 3,111,907 | 11/1963 | Plasser et al. | 104/7 R |
| 3,111,908 | 11/1963 | Plasser et al. | 104/7 R |
| 3,143,974 | 8/1964 | Oville | 104/7 R X |
| 3,799,058 | 3/1974 | Plasser et al. | 104/7 R |
| 3,910,195 | 10/1975 | Theurer | 104/7 R |

FOREIGN PATENT DOCUMENTS

| | | | |
|---|---|---|---|
| 986,362 | 3/1976 | Canada | 104/7 A |
| 2,156,380 | 7/1975 | Fed. Rep. of Germany | 104/7 R |

*Primary Examiner*—Albert J. Makay
*Assistant Examiner*—Carl Rowold

[57] ABSTRACT

The invention provides for a stop device positioned on a railroad track shifting machine such as a track lifting and/or tamping machine and a sensor for generating a control signal to terminate or control the shifting action of the machine when the shifting force on the rail exceeds a predetermined value.

2 Claims, 3 Drawing Figures

RAILROAD TRACK SHIFTING MACHINE WITH SHIFT LIMITING DEVICE

This application is a continuation-in-part of application Ser. No. 694,040, filed June 8, 1976, now abandoned.

BACKGROUND OF THE INVENTION

It is known in the art of railroad track shifting machines, such as track lifting and/or tamping machines, to provide on a rigid frame, an adjustable shift stop which provides a rail engaging surface against which the track "bottoms" during shifting operations, such as a lifting and/or tamping operation, so as to prevent further lifting of the track. After a rail engages the stop, however, the continuation of the jacking or tamping can cause damage to the rail between the stop and the point of shift.

SUMMARY OF THE INVENTION

According to the present invention, there is provided a track shifting device comprising a rigid load supporting frame, track shifting means mounted on said frame, a stop device on said frame limiting the shifting of said track, and a pressure sensing means positioned adjacent said stop device for being engaged by the track when said shifted track is engaged with said stop device to sense a shifting force exerted on the rail after contact with said stop device and having a magnitude greater than a predetermined value and to generate a signal only after the rail has been brought into firm contact with the stop device, said pressure sensing means being connected to said track shifting means for controlling the shifting force, whereby the rail is always shifted to a predetermined shifted position in which it is in firm contact with said stop device.

Preferably the track shifting device is a track lifting and tamping machine and the track shifting means is a track lifting device and tamping means which achieves the lifting by acting directly on the rail while tamping ballast under the ties and rail to raise the track.

DESCRIPTION OF THE DRAWINGS

The following is a description, by way of example only, of two embodiments of the invention, reference being made to the accompanying drawings in which.

DESCRIPTION OF THE PREFERRED EMBODIMENT

Figure 1:
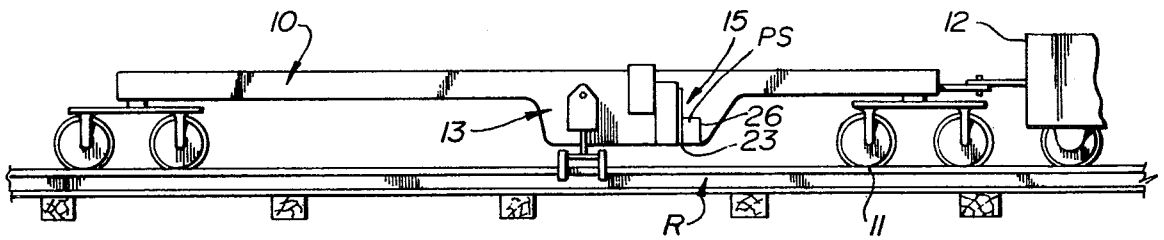
FIG. 1 is a diagrammatic representation of a track lifting device utilizing the stop device and the sensing means.

The following description is of embodiments in which the shifting of the track is lifting only. It will be appreciated, however, that the invention is applicable to machines for shifting the track in other directions e.g. laterally, and it is not intended that the invention be limited to machines carrying out lifting.

Referring now to the drawings, wherein it will be understood that the following explanation is limited to one side of the machine only and that the other side may be exactly symmetrical, a lift beam 10, mounted on wheels 11 so that it can be pushed along the track by machine 12, carries track lifting means in the form of a track lifting jack 13 of known configuration and/or a track tamping device (not shown) also of known type. A stop device shown generally at 15, which is height adjustable, is provided in the vicinity of the tamping heads in known fashion. It is to be understood that the lift beam 10 could be the frame of a track working machine, and particularly a tamping machine, the parts of which are conventional and hence are not shown.

Figure 2:
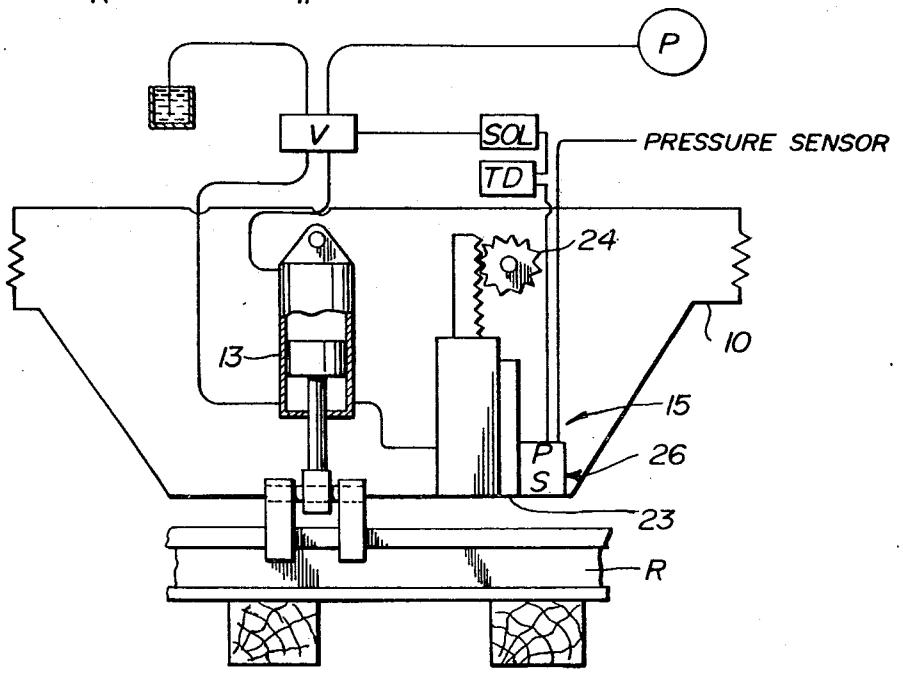
FIG. 2 is an enlarged view of the stop device and sensing means.

The stop device 15 has a rail engaging head 23 which acts as a stop for the rail R. As clearly shown in FIG. 2, the stop device 15 is also provided with a ratchet 24 for adjusting the height of the rail engaging heads 23 relative to the lift beam 10. A sensing means in the form of a pressure sensitive (PS) transducer 26 is carried by the rail engaging heads 23, the transducer having electrical connections diagrammatically shown in FIG. 2 and a control valve V which controls application of hydraulic pressure fluid to the track lifting means, namely the jack 13 and/or the tamping device (not shown).

When shifting a railroad track and especially when lifting it to a predetermined position as established by the stop device 15, it is important that the rail be brought into firm contact with the stop device 15. This is because the exact predetermined position will not be reached until the firm contact is brought about. Mere touching of the rail to the stop device will not always insure that the rail is at the desired predetermined position. Moreover, particularly in the case of lifting the track to a desired level and then tamping ballast under it to maintain it at that level, it is important that the rail be seated firmly against the stop which is attached to the frame so that the weight of the frame opposes further lifting of the rail while further tamping is carried out. In addition, it is very important to avoid excess force on the rail, which tends to bend the rail between the stop device and the point of application of the force.

Thus, when the track lifting jack 13 and/or the tamping heads commence the squeeze operation in order to vertically lift the rails R of the track into the desired position, the rail R first touches the pressure sensitive transducer 26 and then exerts a force thereon. When firm contact has been established as determined by a predetermined pressure acting on the transducer, this causes the transducer to generate a signal to operate the valve V to immediately terminate or control the lifting and/or the tamping operation which has resulted in the force tending to lift the track. Where further tamping is to be carried out, only the lifting force will be terminated and the tamping force continued at least for a while. If desired, a reversal of the lifting force on the rail may be initiated. Thus, as the rail comes into firm contact with the stop at a predetermined fixed position, not only does the stop physically prevent further lifting of the rail but it may also immediately terminate any further tendencey to lift the rail.

The stop device 15 may be raised or lowered on the frame 10 by means of the ratchet 24 and this permits the height of the rail engaging heads 23 on each side of the machine to be individually adjusted relative to the frame 10 so as to allow for the track being in a super-elevated condition. Due to the geometric condition which exists in super-elevated curves, particularly in transition curves, a gradual adjustment may be required to compensate for changes in the track geometry. To this end, the individually adjustable rail engaging heads 23 can be manually adjusted by operator control or they may be adjusted by a preprogrammed apparatus such as a drive cam which thereby makes the necessary compensation.

Figure 3:
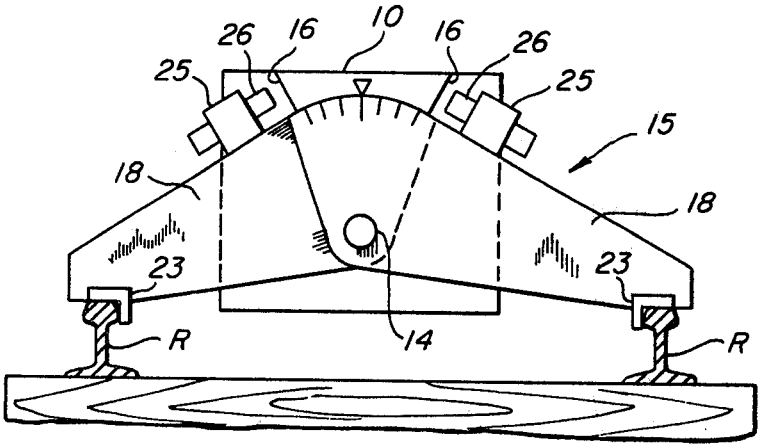
FIG. 3 shows a second embodiment of the track lifting device which also utilizes a stop and sensing means.

A second form of the invention is shown in FIG. 3 wherein outwardly extending arms 18 are pivotally connected to shaft 14. The arms 18 are held in their desired position by known apparatus (not shown) and this aspect of the operation of the outwardly extending arms forms no part of the present invention. The outwardly extending arms 18 carry the rail engaging heads 23 and the shaft 14 is rigidly connected to the frame 10. Located on the frame 10 is the stop device 15 which comprises the stops 16 and the limiters 25, the stops and the limiters being adapted for contact therebetween. The sensing means is in the form of transducer 26 which is carried by the limiters 26. Limiters 25 are rigidly connected to the outwardly extending arms 18 and are adjustable such that the individual rails may be vertically lifted to various desired end positions according to the adjustment made to the limiters 25. Individual adjustment of each of the limiters is possible, as in the first embodiment described, so that compensation may be made for the individual rails when they are required to be in a super-elevated condition.

When the rail has reached a position where limiter 25 has firmly contacted stop 16, the transducer 26 on the limiter 25 transmits the appropriate signal to immediately terminate or control the lifting and/or tamping operation which has resulted in the force tending to lift the rail. If desired, a reversal of the lifting force on the rail may be initiated. Thus, as the rail causes the limiter to come into firm contact with the stop, not only does the stop physically prevent further lifting of the rail but it may also immediately terminate any further tendency to lift the rail.

Further embodiments of the invention but still within its scope are possible. The ratchet 24 used for vertical adjustment of the rail engaging heads 23 may be replaced with any apparatus allowing vertical adjustment of the rail engaging heads, such as a cam, a screw device, or another appropriate mechanism. So, similarly, may the limiters 25 be replaced by an appropriate mechanism. While the pressure sensitive transducer 26 is shown as being mounted on the rail engaging heads 23 or the limiters 25, it may be mounted elsewhere as long as the appropriate signal is sent to the lifting jack to terminate or control the lifting operation when rail contact is made. The transducer 26 may comprise any one of a number of suitable devices which would include pressure sensitive cells, a spool of a spool operation valve means or a proximity indicator which would indicate the position of the track. Accordingly, the invention should be construed only by reference to the accompanying claims.

What we claim as our invention is:

1. A track shifting device having a rigid load supporting frame, track shifting means mounted on said frame for shifting the track, a stop device on said frame in the path of movement of the track being shifted by said track shifting means for limiting the shifting of said track, and a pressure sensing means positioned adjacent said stop device for being engaged by the track when said shifted track is engaged with said stop device to sense a shifting force exerted on the rail by said track shifting means after contact with said stop device which shifting force has a magnitude greater than a predetermined value and to generate a signal only after the rail has been brought into firm contact with the stop device, said pressure sensing means being connected to said track shifting means for controlling the operation of said track shifting means to limit the shifting force applied to the track in response to said signal, whereby the rail is always shifted to a predetermined shifted position in which it is in firm contact with said stop device.

2. A track lifting and tamping device having a rigid load supporting frame, track lifting means for lifting the track and tamping means mounted on said frame, a stop device on said frame in the path of movement of the track being lifted by said track lifting means for limiting the lifting of said track, and a pressure sensing means positioned adjacent said stop device for being engaged by the track when said lifted track is engaged with said stop device to sense a lifting force exerted on the rail by said track lifting means after contact with said stop device which lifting force has a magnitude greater than a predetermined value and to generate a signal only after the rail has been brought into firm contact with the stop device, said pressure sensing means being connected to said track lifting means for controlling the operation of said track lifting means to limit the lifting force applied to the track in response to said signal, whereby the rail is always lifted to a predetermined lifted position in which it is in firm contact with said stop device, and the weight of the load supporting frame is exerted through the stop device onto the lifted rail to oppose further lifting while tamping is continued.

* * * * *